United States Patent [19]

Pfister

[11] 4,114,220

[45] Sep. 19, 1978

[54] COMBINATION LEVELING AND GRADE CHECKING TOOL

[76] Inventor: Barry Lee Pfister, 2259 Ellington, Walled Lake, Mich. 48088

[21] Appl. No.: 777,340

[22] Filed: Mar. 14, 1977

[51] Int. Cl.[2] ..... E01C 19/12; G01C 15/06

[52] U.S. Cl. ..... 15/105; 15/235.4; 33/293

[58] Field of Search ..... 15/235.4–235.8, 15/236 R, 236 NO, 236 A, 104 S, 105; 33/293–296; 37/53; 172/371; 248/158; 294/3.5; 404/97, 118

[56] References Cited

U.S. PATENT DOCUMENTS

| | | | |
|---|---|---|---|
| 988,457 | 4/1911 | Glasscock | 15/235.8 |
| 3,082,460 | 3/1963 | Haivala | 15/235.4 |
| 3,442,016 | 5/1969 | Kaye | 33/293 |
| 4,037,668 | 7/1977 | Svejda | 172/371 |

FOREIGN PATENT DOCUMENTS

| | | | |
|---|---|---|---|
| 1,541,265 | 8/1968 | France | 33/74 D |
| 302,124 | 10/1932 | Italy | 294/3.5 |

*Primary Examiner*—Daniel Blum
*Attorney, Agent, or Firm*—Harry R. Dumont

[57] ABSTRACT

A hand tool particularly useful for concrete work and for providing the combined operations of raking, leveling and setting grade. The tool includes a base plate, a vertically upstanding handle and an adjustable sight collar slidably mounted on the handle with a sight groove and adjustable thumb screw to allow for accurate grade checking.

6 Claims, 1 Drawing Figure

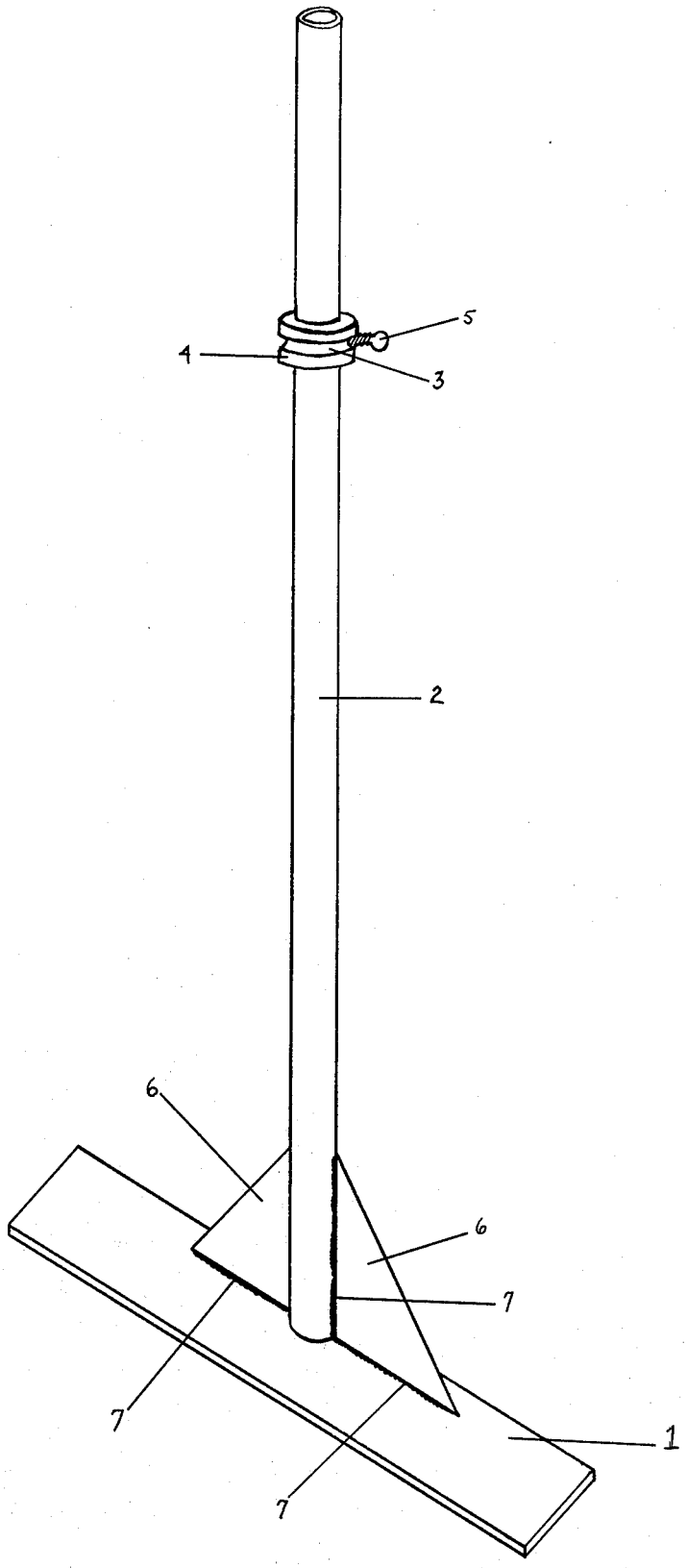
5
4
3
2
6
6
7
7
7
1

COMBINATION LEVELING AND GRADE CHECKING TOOL

BACKGROUND OF THE INVENTION

In the usual process of pouring concrete, one worker on the crew is designated to maintain a constant grade. The hand tool according to the present invention can be used to perform all three operations: raking, leveling and checking grade throughout the three different steps of concrete construction work from footings to flatwork or floors and walls. According to earlier practice, one worker must hold a ruler and a hand trowel in two hands each time the grade is checked and set. If the concrete is not at the correct height, this worker must bend over and with his hand trowel scrape up concrete into a pile. This operation must be repeated over and over again until the grade is correctly set.

The hand tool provided by this invention is used in place of the hand trowel and ruler and functions as a single tool when grade checking is performed. It makes the job easier and eliminates the back strain and exertion of the worker being required to bend over and then stand up all day to rake, pile concrete, level and maintain grade.

The hand tool can be used for raking and leveling with the base plate. The handle is rigidly mounted substantially perpendicular to the base plate so that it forms a vertical support for the slidable adjustable collar which can be moved upwardly or downwardly on the handle and fastened where desired through a locking means. A circumferential sight groove formed in the collar makes it easy to check grade when this is necessary. The checking is accomplished in a manner known to the art either in conjunction with a transit or a laser beam device used to locate on the sight groove.

BRIEF DESCRIPTION OF THE DRAWINGS

The features and advantages of the invention will become apparent from the following description of the invention, taken along with the accompanying drawing which is a perspective view of the preferred embodiment of my invention.

DETAILED DESCRIPTION OF THE PREFERRED EMBODIMENT

My tool includes a relatively flat baseplate 1 and a substantially vertical handle 2 which are securely fastened together by a pair of gussets 6. A weldment 7 is used to secure the parts together. A sight collar 4 is slidably mounted on the handle 2 and further includes a sight groove 3 and a thumb screw 5. The sight groove 3 is located midway between the top and bottom edges of the collar 4 and extends circumferentially around the surface of the collar 4. The sight groove 3 preferably includes a bright color tape or other marking to provide easy visibility when used with a transit or laser beam in grade checking. It will be understood that the handle 2 serves the function of a ruler when used in a grade checking operation. The sight collar 4 can be securely fastened at any level with the thumb screw 5.

It will thus be seen that I have provided by my invention a manual tool which is useful in raking, leveling of concrete or similar construction materials such as asphalt, terrazo, grout or even dirt. The several parts of my tool are preferably constructed of magnesium or other light but strong materials. My invention provides such a tool with the added function of grade checking by merely positioning the base plate such that a sighting may be made from any leveling instrument positioned at a remote location. Examples of such instruments are transits and laser beam sighting devices, both of which are well known in the construction art.

I claim:

1. A hand tool for raking and leveling concrete and for establishing a grade level comprising: a base plate; a handle mounted substantially perpendicular and centrally on said base plate and fixed thereto for performing the raking and leveling function; a sight collar slidably mounted on said handle and having a sight portion to provide for an accurate alignment of grade level from a remote sighting device, said sight portion comprising a sight groove circumferentially extending about said collar and located substantially equidistant between the top and bottom edges of said sight collar and a bright colored material in said sight groove for facilitating alignment.

2. The combination as set forth in claim 1 wherein a locking means is operatively connected to said sight collar for fixing it as a selected point on said handle to allow for grade checking.

3. The combination as set forth in claim 2 wherein said locking means comprises a thumb screw having its threaded portion extending through a mating threaded opening in said sight collar and into holding relationship with said handle at said selected point.

4. The combination as set forth in claim 1 wherein a pair of gussets are included for securely holding said handle in its position substantially perpendicular to said base plate.

5. The combination as set forth in claim 4 wherein a weldment is included for securely fastening said gussets to said handle and to said base plate, respectively.

6. The combination as set forth in claim 4 wherein said handle, said collar, said base plate and said gussets are constructed of magnesium.

* * * * *